US007462990B2

(12) United States Patent
Hong

(10) Patent No.: US 7,462,990 B2
(45) Date of Patent: Dec. 9, 2008

(54) PLASMA DISPLAY PANEL PROVIDED WITH DUMMY ADDRESS ELECTRODES PROTRUDING INTO A NON-DISPLAY REGION AND COVERED WITH A COMPOSITE LAYER

(75) Inventor: Chong-Gi Hong, Suwon-si (KR)

(73) Assignee: Samsung SDI Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 11/329,118

(22) Filed: Jan. 11, 2006

(65) Prior Publication Data

US 2006/0158115 A1 Jul. 20, 2006

(30) Foreign Application Priority Data

Jan. 17, 2005 (KR) ..... 10-2005-0004148

(51) Int. Cl.
*H01J 17/49* (2006.01)

(52) U.S. Cl. ..... 313/586; 313/582; 313/584; 313/587

(58) Field of Classification Search ..... 313/582–587
See application file for complete search history.

(56) References Cited

U.S. PATENT DOCUMENTS 6,140,767 A * 10/2000 Sreeram et al. ..... 313/582
6,646,376 B2 * 11/2003 Yonehara et al. ..... 313/582
6,821,177 B2 * 11/2004 Mitomo ..... 445/24
6,821,178 B2 * 11/2004 Sugimoto et al. ..... 445/24
6,822,393 B2 * 11/2004 Kim ..... 313/582
6,828,731 B2 * 12/2004 Kang et al. ..... 313/587
6,870,314 B2 * 3/2005 Kifune et al. ..... 313/582
6,884,142 B2 4/2005 Kang et al.
7,008,284 B2 * 3/2006 Ohkubo et al. ..... 445/24
2003/0030375 A1 * 2/2003 Nakada et al. ..... 313/582
2003/0076039 A1 * 4/2003 Ookawa et al. ..... 313/587
2004/0056597 A1 * 3/2004 Ko et al. ..... 313/582
2006/0119265 A1 * 6/2006 Cho ..... 313/582

FOREIGN PATENT DOCUMENTS

JP 05135702 A * 6/1993
JP 2001-312972 11/2001

* cited by examiner

*Primary Examiner*—Mariceli Santiago
(74) *Attorney, Agent, or Firm*—Lee & Morse, P.C.

(57) ABSTRACT

A plasma display panel includes first and second substrates facing each other and divided into a display area and a non-display area, barrier ribs disposed between the first and second substrates, the barrier ribs defining a display discharge cell in the display area and a non-display discharge cell in the non-display area, a sustain electrode disposed between the first and second substrates, an address electrode disposed between the first and second substrates, the address electrode being perpendicular to the sustain electrode, the address electrode including a first dummy address electrode that protrudes on at least one end from an outermost barrier rib in the non-display region, and a composite layer covering the address electrode including at least a part of the first dummy address electrode. The composite layer may be formed of the same material as and may be a single body with the barrier ribs.

21 Claims, 4 Drawing Sheets

PLASMA DISPLAY PANEL PROVIDED WITH DUMMY ADDRESS ELECTRODES PROTRUDING INTO A NON-DISPLAY REGION AND COVERED WITH A COMPOSITE LAYER

BACKGROUND OF THE INVENTION

1. Field of the Invention

The present invention relates to a plasma display panel. More particularly, the present invention relates to a plasma display panel which can prevent a dummy address electrode from being damaged during a manufacturing process.

2. Description of the Related Art

Plasma display panels are flat display panels that form an image using a gas discharge phenomenon. Plasma display panels can be used to provide a large screen having a high picture quality that is thin and has a wide viewing angle. Thus, there is much interest in plasma display panels.

These plasma display panels include first and second substrates, which face each other and are spaced apart by a predetermined gap, barrier ribs defining a discharge cell disposed between the first and second substrates, a discharge gas filling the discharge cell, a phosphor coating the surface of the discharge cell, and electrodes. The electrodes include a plurality of sustain electrode pairs on the first substrate and a plurality of address electrodes on the second substrates. The address electrodes extend across the sustain electrode pairs and the discharge cell. When a direct current (DC) or an alternating current (AC) is applied to the electrodes, discharge occurs in the discharge cell, causing the discharge gas to emit ultraviolet (UV) light, thereby exciting the phosphor to emit visible light, thus forming an image.

Plasma display panels are divided into a display region, in which an image is displayed, and a non-display region, in which an image is not displayed. Dummy barrier ribs and a dummy address electrode are disposed in the non-display region. Dummy barrier ribs prevent an edge effect of discharge non-uniformity. The dummy address electrode is an end of the address electrode that protrudes from the outermost dummy barrier rib of the dummy barrier ribs.

A dielectric layer is typically coated on the electrodes, and then the barrier ribs are formed on the dielectric layer in a separate step during manufacture of a conventional plasma display panel. Thus, the dummy address electrode, which does not have the barrier ribs formed thereon, is covered only with the dielectric layer during formation of the barrier ribs. Therefore, the dummy address electrode is affected by processes required for the subsequent formation of the barrier ribs. In other words, the dielectric layer is insufficient to protect a portion of the dummy address electrode adjacent to the dummy barrier ribs during processes used for forming the barrier ribs, e.g., drying, sandblasting and firing, and the portion is easily damaged.

SUMMARY OF THE INVENTION

The present invention is therefore directed to a plasma display panel, which substantially overcomes one or more of the problems due to the limitations and disadvantages of the related art.

It is therefore a feature of an embodiment of the present invention to provide a plasma display panel in which a composite layer covers address electrodes so that a dummy address electrode is prevented from being damaged during subsequent manufacturing processes.

It is therefore another feature of an embodiment of the present invention to provide a plasma display panel in which barrier ribs are made of the same material as that of the composite layer covering the address electrodes.

It is therefore yet another feature of an embodiment of the present invention to provide a plasma display device in which the barrier ribs and the composite layer are formed as a unitary structure It is therefore still another feature of an embodiment of the present invention to provide a plasma display panel which can be manufactured more simply and at a reduced cost.

It is yet another feature of an embodiment of the present invention to provide a plasma display device having a composite layer formed lower than the bottom surface of the barrier ribs or a discharge cell, thereby widening an exhaust space such that a discharge gas is smoothly exhausted.

At least one of the above and other features and advantages of the present invention may be realized by providing a plasma display panel, including first and second substrates facing each other and divided into a display area and a non-display area, barrier ribs disposed between the first and second substrates, the barrier ribs defining a display discharge cell in the display area and a non-display discharge cell in the non-display area, a sustain electrode disposed between the first and second substrates, an address electrode disposed between the first and second substrates, the address electrode being perpendicular to the sustain electrode, the address electrode including a first dummy address electrode that protrudes from an outermost barrier rib in the non-display region on at least one end of the address electrode, and a composite layer covering the address electrode including at least a part of the first dummy address electrode.

At least one end of the composite layer may protrude from the outside of an outermost line of a portion where the first substrate and the second substrate overlap.

The composite layer may be higher or lower than a bottom of the discharge cell and lower than the barrier ribs from a surface of the second substrate that faces the first substrate. The composite layer may have a same height as the barrier ribs from a surface of the second substrate that faces the first substrate.

The plasma display panel may include a sealing unit between the first substrate and the second substrate. The sealing unit may be above the composite layer. The sealing unit may be frit glass.

The plasma display panel may include a second dummy address electrode having an address electrode entirely in the non-display region.

The composite layer may be a same material as the barrier ribs. The composite layer and the barrier ribs may form a single body.

The sustain electrode may include a common electrode and a scan electrode. Both ends of the address electrode may protrude from an outermost barrier rib.

BRIEF DESCRIPTION OF THE DRAWINGS

The above and other aspects and advantages of the present invention will become more apparent to those of ordinary skill in the art by describing in detail exemplary embodiments thereof with reference to the attached drawings in which.

DETAILED DESCRIPTION OF THE INVENTION

Figure 1:
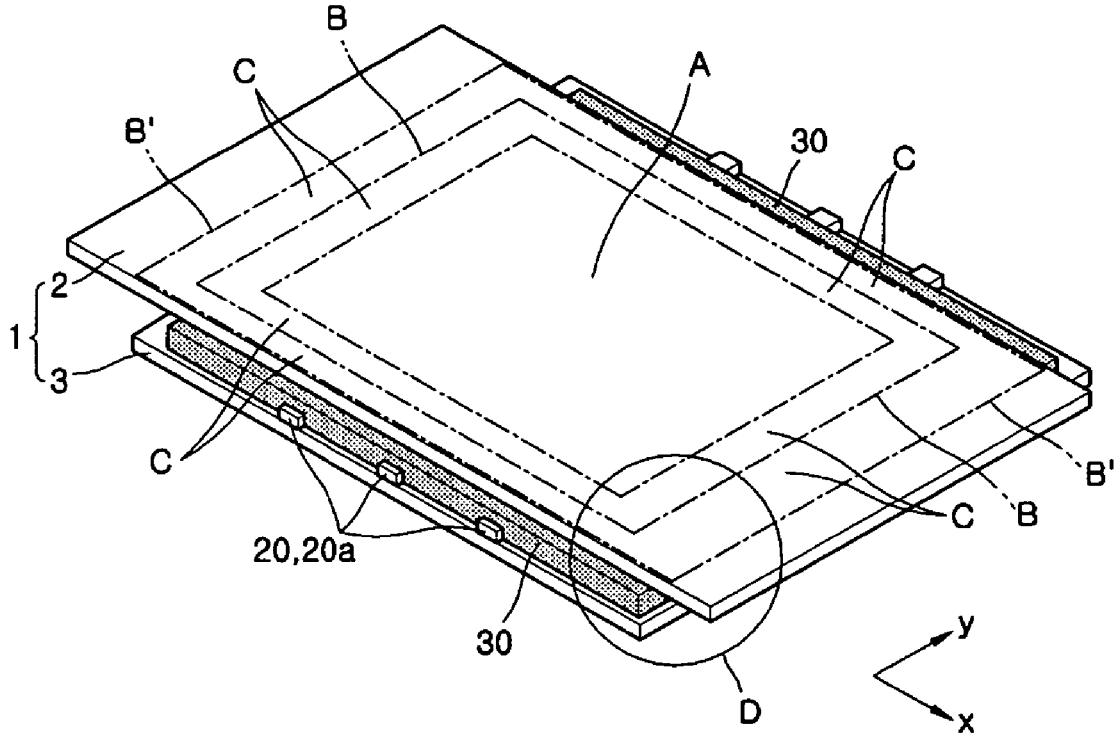
FIG. 1 illustrates a schematic diagram of a plasma display panel according to an embodiment of the present invention.

Korean Patent Application No. 10-2005-00004148, filed on Jan. 17, 2005, in the Korean Intellectual Property Office, and entitled: "Plasma Display Panel," is incorporated by reference herein in its entirety.

The present invention will now be described more fully hereinafter with reference to the accompanying drawings, in which exemplary embodiments of the invention are shown. The invention may, however, be embodied in different forms and should not be construed as limited to the embodiments set forth herein. Rather, these embodiments are provided so that this disclosure will be thorough and complete, and will fully convey the scope of the invention to those skilled in the art. In the figures, the dimensions of layers and regions are exaggerated for clarity of illustration. Like reference numerals refer to like elements throughout.

Figure 2:
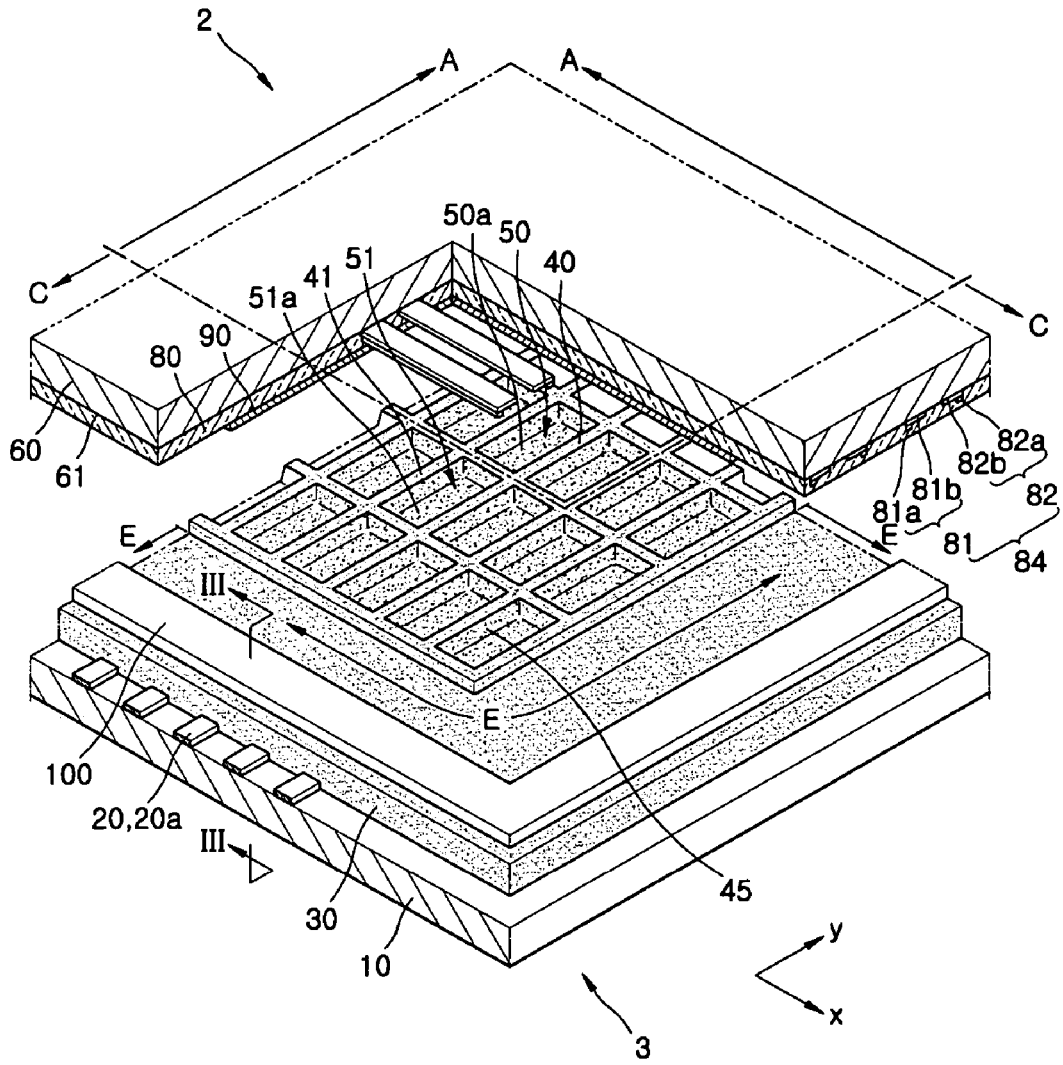
FIG. 2 illustrates a partially-cut exploded perspective view shown by enlarging a portion D of FIG. 1.
Figure 3:
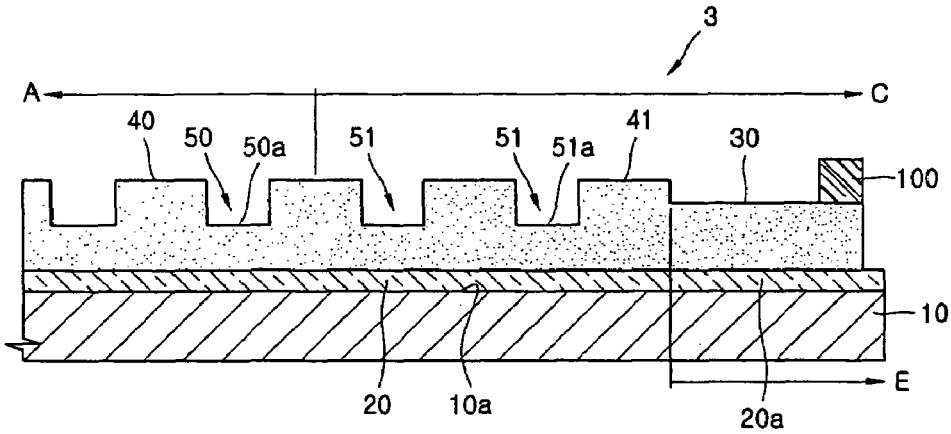
FIG. 3 illustrates a partially-cut cross-sectional view taken along line III-III of FIG. 2 according to a first embodiment of a composite layer of the present invention.

Referring to FIGS. 1 through 3, a plasma display panel 1 includes a first panel 2, a second panel 3 and a sealing unit 100.

The first panel 2 may include a first substrate 60, a sustain discharge electrode pair 84 on a bottom side 61 of the first substrate 60, a dielectric layer 80 covering the sustain discharge electrode pair 84 and a protective layer 90 covering the dielectric layer 80.

The sustain discharge electrode pair 84 may include a common electrode 81 and a scan electrode 82, each of which may have transparent electrodes 81*b* and 82*b* and bus electrodes 81*a* and 82*a*, respectively. However, the present invention is not to be so limited, and the common electrode 81 and the scan electrode 82 may include only bus electrodes.

The second panel 3 may include a second substrate 10, address electrodes 20 on the second substrate 10, a composite layer 30 that covers the address electrodes 20, barrier ribs 40 and 41, and a phosphor layer 45 formed in discharge cells 50 and 51 defined by the barrier ribs 40 and 41 and the composite layer 30. As shown herein, the barrier ribs 40, 41 may be formed as a single body with the composite layer 30.

The discharge cells 50 and 51 are divided into display discharge cells 50 in a display region A in which an image is displayed, and non-display discharge cells 51 in a non-display region C in which an image is not displayed. The barrier ribs 40 and 41 are formed above the composite layer 30 that covers the address electrodes 20 and partitions off a discharge space into a plurality of discharge cells 50 and 51. The barrier ribs 40 and 41 include a main barrier rib 40 that partitions off the display discharge cell 50 and a dummy barrier rib 41 that partitions off the non-display discharge cell 51. Here, the display discharge cell 50 partitioned off by the main barrier rib 40 is in the center of the plasma display panel 1 and realizes an image by discharge.

In accordance with the present invention, an end part or both end parts of the address electrodes 20 protruding from the outermost dummy barrier rib 41 of the dummy barrier ribs 41 is referred to as a first dummy address electrode 20*a*.

The barrier ribs 40 and 41 including the main barrier rib 40 and the dummy barrier rib 41, and the composite layer 30 that is disposed outside of the outermost dummy barrier rib 41 and covers a predetermined non-display region (E of FIGS. 2 and 3) including the first dummy address electrode 20*a* may be formed of the same material and as a single body. In other words, the same material may be used for both the barrier ribs 40, 41 and the composite layer 30. Further, the barrier ribs 40, 41 and the composite layer 30 may be formed as one layer using the same manufacturing process. Then, this one layer may be partitioned off into the barrier ribs 40, 41 and the composite layer 30 through subsequent processing, e.g., sandblasting, and completed.

Referring to FIGS. 2 and 3, the size and shape of the display discharge cell 50 and the non-display discharge cell 51 are the same, but the present invention is not limited to this. The non-display discharge cell 51 may be formed to have a different size and/or shape from that of the display discharge cell 50. The number of the non-display discharge cells 51 is also not limited.

Both the barrier ribs 40 and 41 and the composite layer 30 may be formed of a composite material including a dark-color material, e.g., manganese (Mn) or cobalt (Co), and a white material, e.g. titanium oxide ($TiO_2$) and alumina ($Al_2O_3$) mixed at a predetermined ratio. Thus, the barrier ribs 40 and 41 and the composite layer 30 have larger strength than that of a conventional dielectric layer, which would have the same property as the dielectric layer 80 of FIG. 2. In other words, the composite layer 30 can withstand the subsequent processing of the plasma display panel required after formation of the address electrodes, which would remove a conventional dielectric layer, and thus protect the dummy address electrodes 20*a*.

In this way, the barrier ribs 40 and 41 and the composite layer 30 may be formed as a single layer using one process and then be respectively partitioned off and completed. Thus, a process of manufacturing the plasma display panel 1 is simplified and costs can be reduced. At least a part of the first dummy address electrode 20*a*, i.e., the portion adjacent the outermost dummy barrier rib 41, is covered with the composite layer 30 having improved strength compared to a conventional dielectric layer, such that damages that may occur during manufacturing of the plasma display panel 1 can be prevented.

The dark-color material and the white material having different diameters may be mixed such that upper portions of the barrier ribs 40 and 41 may be formed of a dark-color layer or a white layer. In this case, a diameter of one of the mixed dark-color material and white material may be about 1 to 2 μm and a diameter of the other material may be about 3 to 4 μm.

The sealing unit 100 sealing an internal space by joining the first panel 2 and the second panel 3 may be disposed between the first substrate 60 and the second substrate 10. The sealing unit 100 may be disposed above the composite layer 30 along a portion in which the first panel 2 and the second panel 3 overlap, i.e., along a boundary B between an outermost line B' of the portion in which the first panel 2 and the second panel 3 overlap and a display region A in which an image is displayed, as can be seen in FIG. 1. However, the present invention is not limited to this, and the sealing unit 100 may be disposed at a side of the composite layer 30 along an outermost line of the composite layer 30, rather than above the composite layer 30. The sealing unit 100 may be frit glass, for example.

At least one end of the composite layer 30 may extend to protrude from the outermost line B' of the portion in which the first panel 2 and the second panel 3 overlap. In this way, the composite layer 30 covers and protects the first dummy address electrode 20*a*, at least at a portion of the first dummy address electrode adjacent to the outermost dummy barrier rib.

FIG. 3 illustrates a partially-cut cross-sectional view taken along line III-III of FIG. 2 according to a first embodiment of a composite layer of the present invention. As can be seen in FIG. 3, the composite layer 30 may be formed to be higher than bottoms 50*a* and 51*a* of the discharge cells 50 and 51 and lower than the barrier ribs 40 and 41 that define the discharge cells 50 and 51. Heights of the bottoms 50*a* and 51*a* of the discharge cells 50 and 51 and the barrier ribs 40 and 41 are measured from a surface 10*a* of the second substrate 10 that faces the first substrate 60. In this manner, an exhaust space between the barrier rib 41 and the sealing unit 100 is widened such that a discharge gas can be easily exhausted through a discharge hole (not shown) formed in an upper portion of the sealing unit 100.

Figure 4:
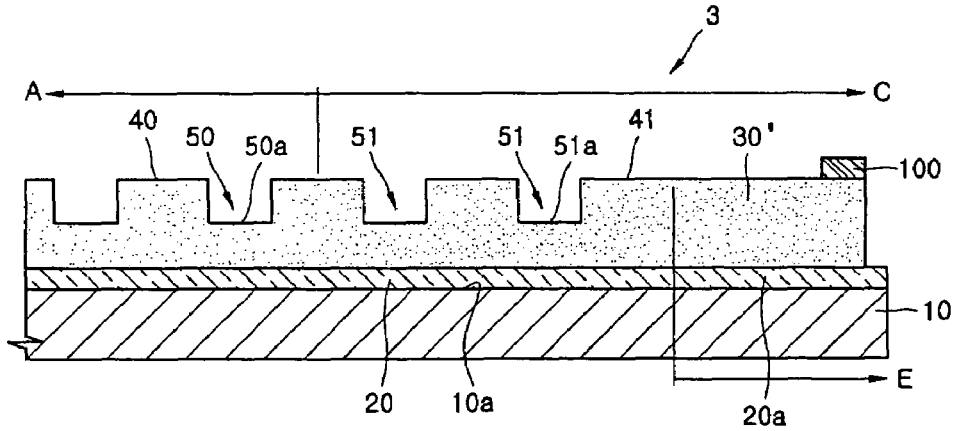
FIG. 4 illustrates a partially-cut cross-sectional view taken along line III-III of FIG. 2 according to a second embodiment of a composite layer of the present invention.

FIG. 4 illustrates a partially-cut cross-sectional view taken along line III-III of FIG. 2 according to a second embodiment of the composite layer of the present invention. The second embodiment of FIG. 4 is different from the first embodiment of FIG. 3 in that a composite layer 30' of FIG. 4 is formed to a same height as that of barrier ribs 40 and 41 that define discharge cells 50 and 51, as shown in FIG. 4. However, in the second embodiment, an exhaust space between the barrier rib 41 and the sealing unit 100 becomes narrow such that a discharge gas may not be smoothly discharged through a discharge hole (not shown) formed in the upper portion of the sealing unit 100 disposed above the composite layer 30'.

Figure 5:
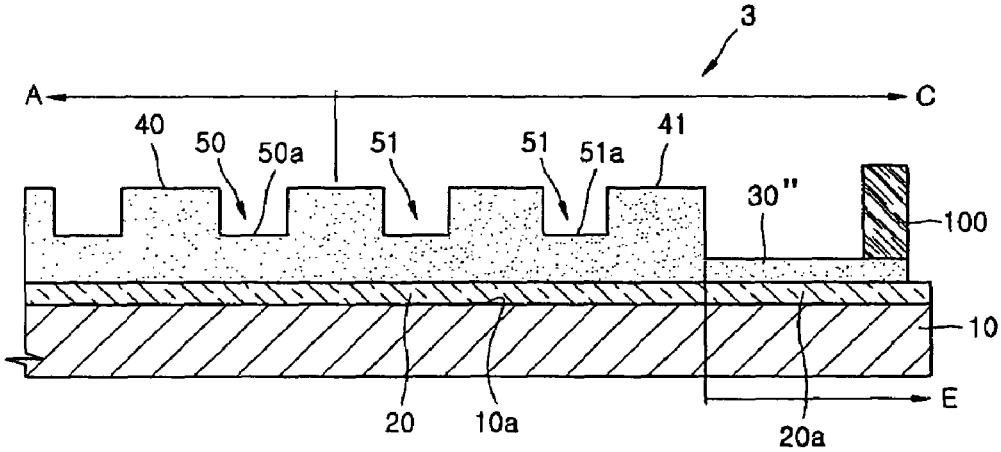
FIG. 5 illustrates a partially-cut cross-sectional view taken along line III-III of FIG. 2 according to a third embodiment of a composite layer of the present invention.

FIG. 5 illustrates a partially-cut cross-sectional view taken along line III-III of FIG. 2 according to a third embodiment of the composite layer of the present invention. The embodiment of FIG. 5 is different from the embodiment of FIG. 3 in that a composite layer 30" of FIG. 5 is formed to be lower than bottoms 50*a* and 51*a* of discharge cells 50 and 51, as shown in FIG. 5. In this way, an exhaust space between the barrier rib 41 and the sealing unit 100 is greatly widened, allowing a discharge gas to be very smoothly discharged.

Figure 6:
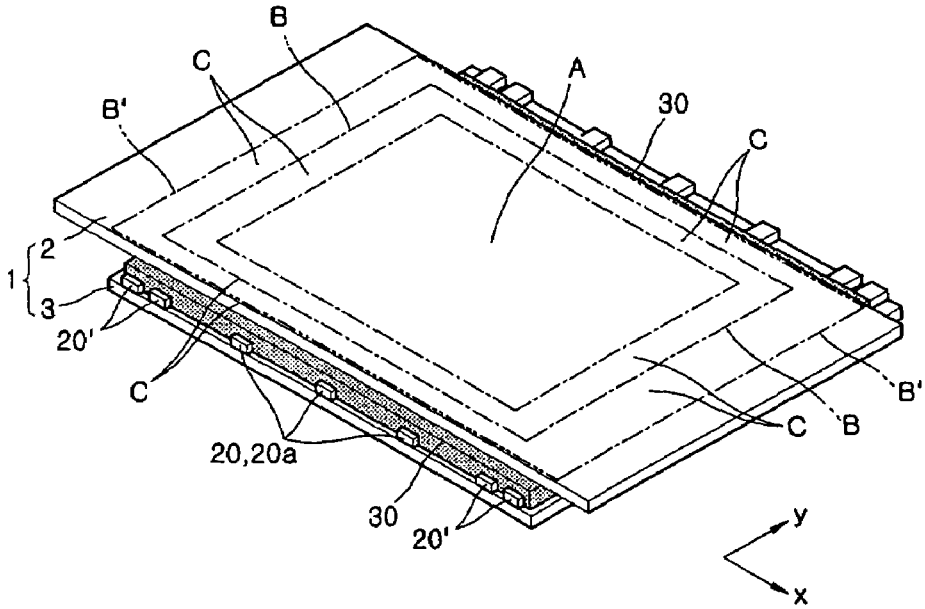
FIG. 6 is a schematic diagram of a plasma display panel according to another embodiment of the present invention.

FIG. 6 is a schematic diagram of a plasma display panel according to another embodiment of the present invention. The embodiment of FIG. 6 is different from the embodiment of FIG. 1 in that at least one second dummy address electrode 20' that can reduce discharge nonuniformity is further disposed in the non-display region C of the plasma display panel 1.

The second dummy address electrode 20' is different from the first dummy address electrode 20*a* in that it is an entire address electrode disposed in the non-display region C of the plasma display panel 1. In other words, no portion of the second dummy electrode 20' is in the display region A. In this way, unnecessary charges that occur in the display region A of the plasma display panel 1 during discharge are adsorbed by the second dummy address electrode 20' such that a discharge effect of the plasma display panel 1 is improved.

A three-electrode alternating-current surface discharge type plasma display panel is used in the embodiments shown in FIGS. 1 through 6. However, the configuration of the first panel 2 and the second panel 3 is not limited to this, and the present invention can be applied to other configurations.

Exemplary embodiments of the present invention have been disclosed herein, and although specific terms are employed, they are used and are to be interpreted in a generic and descriptive sense only and not for purpose of limitation. For example, any of the three embodiments of the composite layer may be used with the plasma display panel shown in FIG. 6. Further, the composite layer may be flush with the bottoms 50*a*, 51*a* of the discharge cell. Accordingly, it will be understood by those of ordinary skill in the art that various changes in form and details may be made without departing from the spirit and scope of the present invention as set forth in the following claims.

What is claimed is:

1. A plasma display panel, comprising:

first and second substrates facing each other and divided into a display area and a non-display area;

barrier ribs disposed between the first and second substrates, the barrier ribs defining a display discharge cell in the display area and a non-display discharge cell in the non-display area;

a sustain electrode disposed between the first and second substrates;

an address electrode disposed between the first and second substrates, the address electrode being perpendicular to the sustain electrode, the address electrode including a first dummy address electrode that protrudes from an outermost barrier rib in the non-display area on at least one end of the address electrode; and a composite layer covering the address electrode including being directly on at least a part of the first dummy address electrode.

2. The plasma display panel as claimed in claim 1, wherein at least one end of the composite layer protrudes beyond the display area.

3. The plasma display panel as claimed in claim 1, wherein the composite layer is higher than a bottom of the discharge cell and lower than the barrier ribs from a surface of the second substrate that faces the first substrate.

4. The plasma display panel as claimed in claim 1, wherein the composite layer has a same height as the barrier ribs from a surface of the second substrate that faces the first substrate.

5. The plasma display panel as claimed in claim 1, wherein the composite layer is lower than a bottom of the discharge cell from a surface of the second substrate that faces the first substrate.

6. The plasma display panel as claimed in claim 1, further comprising a sealing unit between the first substrate and the second substrate and sealing an internal space.

7. The plasma display panel as claimed in claim 6, wherein the sealing unit is above the composite layer.

8. The plasma display panel as claimed in claim 6, wherein the sealing unit comprises frit glass.

9. The plasma display panel as claimed in claim 1, further comprising a second dummy address electrode including an address electrode entirely in the non-display region.

10. A plasma display panel, comprising:

first and second substrates facing each other and divided into a display area and a non-display area;

barrier ribs disposed between the first and second substrates, the barrier ribs defining a display discharge cell in the display area and a non-display discharge cell in the non-display area;

a sustain electrode disposed between the first and second substrates;

an address electrode disposed between the first and second substrates, the address electrode being perpendicular to the sustain electrode, the address electrode including a first dummy address electrode that protrudes from an outermost barrier rib in the non-display area on at least one end of the address electrode; and a composite layer covering the address electrode including at least a part of the first dummy address electrode, wherein the composite layer consists of a same material as the barrier ribs, the composite layer and the barrier ribs form a single body, and the composite layer covering the at least a part of the first dummy address electrode has a different thickness than the composite layer covering the address electrode in the display area.

11. The plasma display panel as claimed in claim 1, wherein the sustain electrode comprises a common electrode and a scan electrode.

12. The plasma display panel as claimed in claim 1, wherein both ends of the address electrode protrude from an outermost barrier rib.

13. The plasma display panel as claimed in claim 10, wherein the composite layer is higher than a bottom of the discharge cell and lower than the barrier ribs from a surface of the second substrate that faces the first substrate.

14. The plasma display panel as claimed in claim 10, wherein the composite layer has a same height as the barrier ribs from a surface of the second substrate that faces the first substrate.

15. The plasma display panel as claimed in claim 10, wherein the composite layer is lower than a bottom of the discharge cell from a surface of the second substrate that faces the first substrate.

16. The plasma display panel as claimed in claim 10, further comprising a second dummy address electrode including an address electrode entirely in the non-display region.

17. The plasma display panel as claimed in claim 10, wherein the composite material includes a mixture of a dark-color material and a white material.

18. The plasma display panel as claimed in claim 17, wherein a diameter of the dark-color material is different from a diameter of the white material.

19. The plasma display panel as claimed in claim 17, wherein the diameter of one of the dark-color and white materials is about 1 to 2 microns, and the diameter of the other one of dark-color and white materials is about 3 to 4 microns.

20. The plasma display panel as claimed in claim 10, wherein the sustain electrode comprises a common electrode and a scan electrode.

21. The plasma display panel as claimed in claim 10, wherein both ends of the address electrode protrude from an outermost barrier rib.

* * * * *